United States Patent [19]

Sibertin-Blanc et al.

[11] Patent Number: 4,694,931

[45] Date of Patent: Sep. 22, 1987

[54] AUTOMATIC TRIPPING RESCUE SYSTEM

[75] Inventors: Jean-Baptiste Sibertin-Blanc; Yves Tellier, both of Paris, France

[73] Assignee: Ecole Nationale Superieure de Creation Industrielle, Paris, France

[21] Appl. No.: 917,496

[22] Filed: Oct. 10, 1986

[30] Foreign Application Priority Data

Oct. 11, 1985 [FR] France ..... 85 15142

[51] Int. Cl.[4] ..... A62B 35/00

[52] U.S. Cl. ..... 182/3; 182/18; 441/89; 441/94; 441/122

[58] Field of Search ..... 182/3–8, 182/18; 272/116; 441/122, 94, 89, 87

[56] References Cited

U.S. PATENT DOCUMENTS

| | | | |
|---|---|---|---|
| 149,513 | 4/1874 | Ormsbee | 441/122 |
| 1,611,427 | 12/1926 | Evans | 441/122 |
| 3,095,568 | 6/1963 | Aine | 441/89 |
| 3,173,162 | 3/1965 | Elder | 441/94 |
| 3,332,415 | 7/1967 | Erickson | 441/122 |
| 3,621,501 | 11/1971 | Jordan | 441/89 |
| 4,300,759 | 11/1981 | Caplan | 272/116 |
| 4,308,629 | 1/1982 | Freemon | 182/3 |

FOREIGN PATENT DOCUMENTS

| | | |
|---|---|---|
| 715883 | 12/1931 | France . |
| 1088936 | 3/1955 | France . |
| 1591320 | 6/1970 | France . |
| 357644 | 11/1961 | Switzerland . |

OTHER PUBLICATIONS

French Examiner Visentin, M. "Rapport De Recherche".

*Primary Examiner*—Reinaldo P. Machado

*Attorney, Agent, or Firm*—Kerkam, Stowell, Kondracki & Clarke

[57] ABSTRACT

An automatic trippling rescue system is intended to rapidly and automatically make a rescued person integral with a rescue link (2). It is essentially comprised of a mobile inflatable sleeve (6), the axial displacement of which around the forearm of the rescued person and then the inflation thereof are automatically tripped by the mere grasping of a handle (23).

This system applies to rescue at sea, in mountains, holes, crevasses, etc.

5 Claims, 3 Drawing Figures

AUTOMATIC TRIPPING RESCUE SYSTEM

This invention relates to an automatic tripping rescue system.

Generally speaking, it relates to human rescue or life-saving in difficult ground conditions (slopes, holes, crevasses, wells, rivers, seas, tanks) and in adverse circumstances for physically weakened or in distress persons.

More precisely, the invention relates to a rescue system of the type comprising a physical, generally supple,link, said link being controlled at one of its extremeties by a rescuer, the other extremity being linked to a fastening system such as a harness or a belt liable to be made integral with a rescued person.

These systems of the prior art all have the drawback that, at the moment when the rescued person is made integral with the fastening system, an important period of time is required to carry out the fastening procedure. A substantial amount of physical energy and a sufficient degree of consciousness are also required. All of these operational conditions are not met in most circumstances in which a rescue or life-saving is to be carried out.

It is precisely an object of the present invention to provide a rescue system of the type mentioned above but improved so as to make the rescued person integral with the fastening system in a simple and hence rapid manner, and by requiring a minimum of physical energy and consciousness.

To achieve these purposes, the invention is concerned with an automatic rescue system of the type comprising a physical, generally supple, link, said link being controlled at one of its extremities by a rescuer, the other extremity of said link being linked to a fastening system able to be made integral with a rescued person, characterized in that said fastening system is comprised of a mobile and inflatable sleeve, in that said system is fitted with a visible and easily sizable manual prehension element, said element being provided with tripping means which are actuated by a mere hand-grasping of this element and intended to firstly automatically and rapidly displace the sleeve to place it around the forearm of the rescued person, then to inflate said sleeve to enclose the wrist and the forearm of the rescued person under a non-traumatising pressure.

This definition, which is at the same time descriptive of the combined means and functional of these means, makes it clear that the device of the invention meets all the functional requirements set forth above.

This will still be more apparent to those skilled in the art from the following detailed description of a preferred embodiment of the invention, given by way of possible examples of carrying out the invention.

Figure 1:
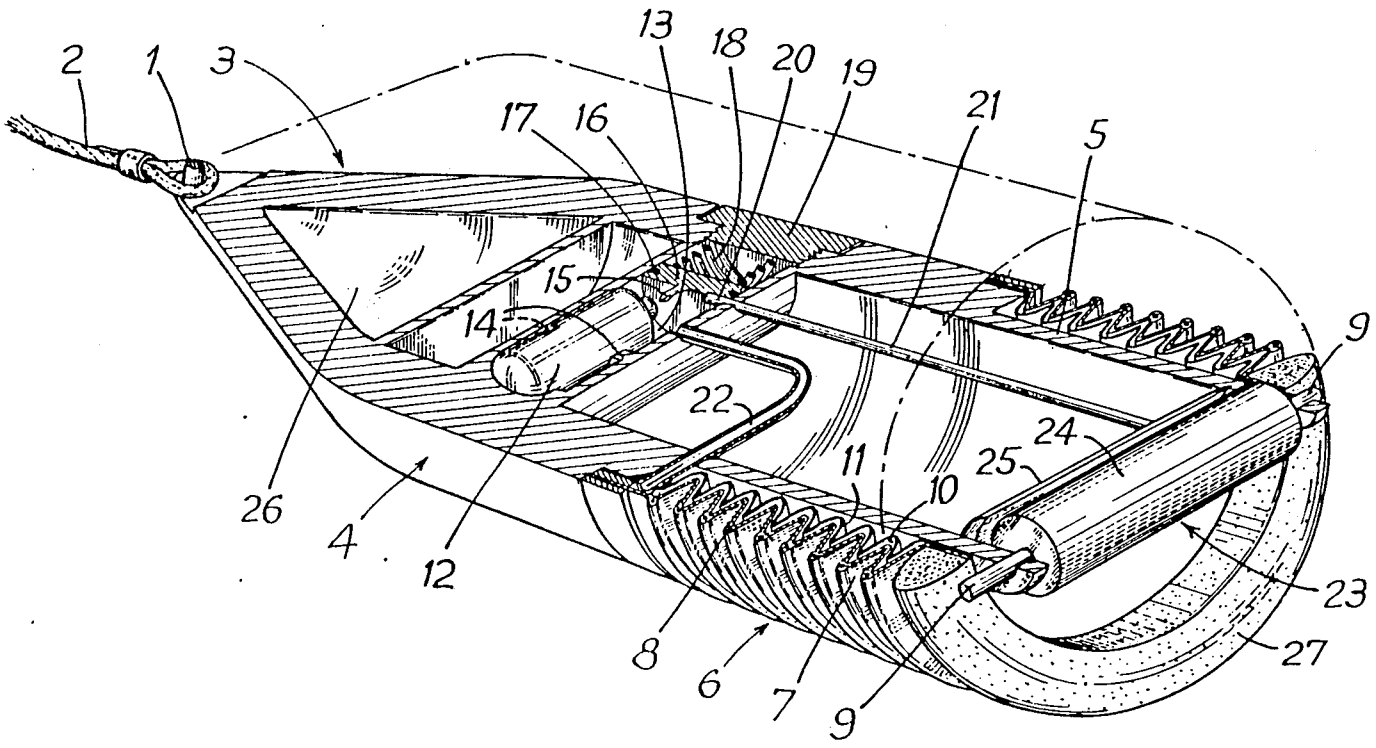
Figure 3:
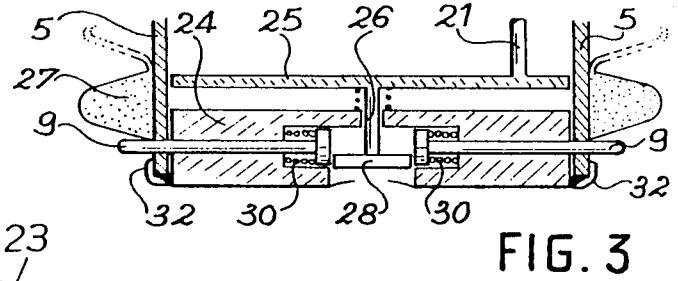
Figure 2:
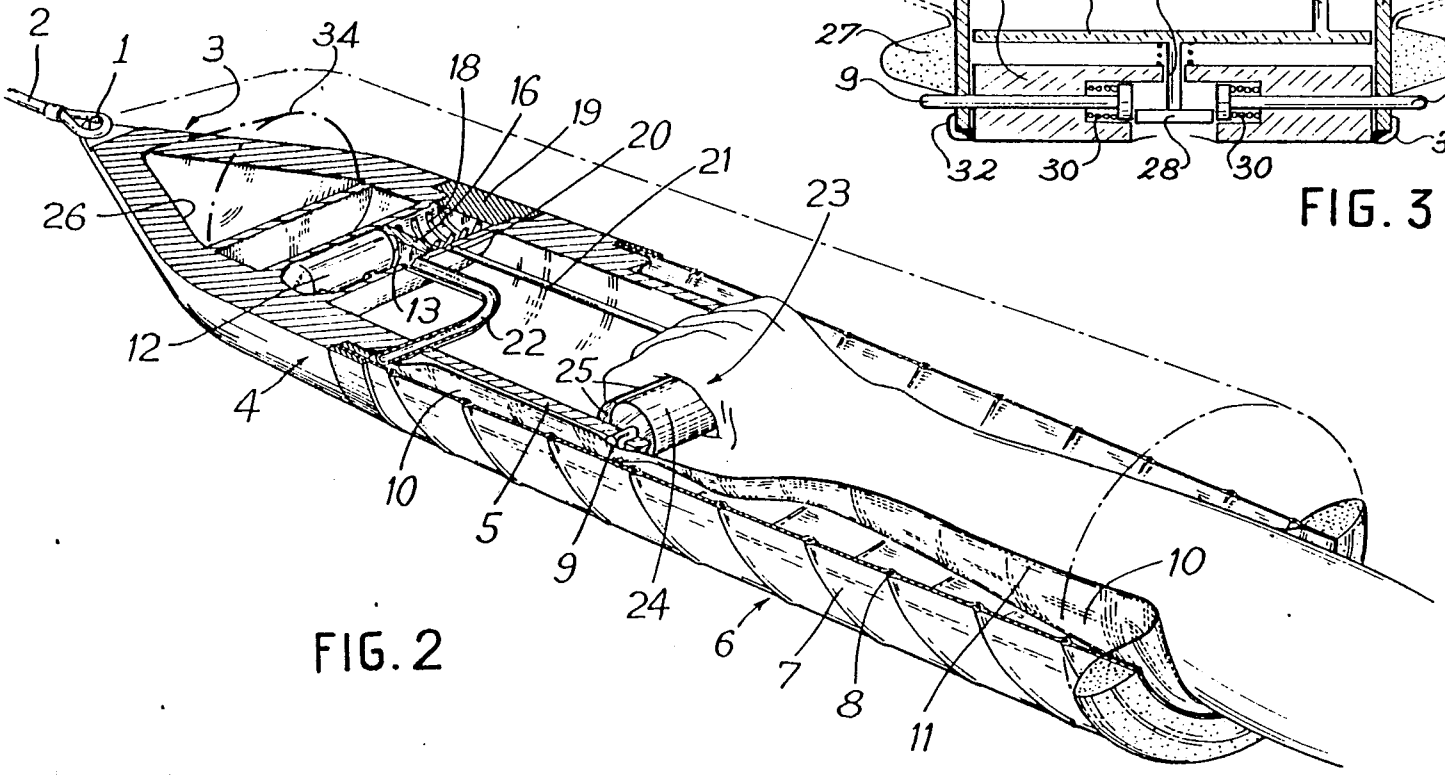

Reference will be made to the accompanying drawings in which :

FIG. 1 is a perspective view cut by an axial plane of the system of the invention before it has been grasped by a rescued person ; whereas FIG. 2 is a similar view of the same system after it has been grasped ; and FIG. 3 is a cross sectional view through the handle of the system of FIGS. 1 and 2 which shows an example of a mechanism for releasing the pins.

The system is fastened by a ring 1 to an extremity of a supple or pliable link 2, such as a cable or a belt, the other extremity of which (not shown) being controlled by a rescuer according to various procedures which are adapted to the conditions of the rescue.

The ring 1 is provided at the frustro-conical forward portion 3 of the hollow body 4.

The rearward portion 5 of the body 4 is surrounded by an inflatable sleeve 6 which is axially mobile outwardly of a body 5.

To these ends, according to the embodiment disclosed here, the sleeve is comprised of a tube 7 made of a pliable plastic material wired with a metal helical wire 6, made of a piano wire and forming a spring. In the compressed or cocked position ready for use illustrated in FIG. 1, the sleeve 6, compressed against the action of spring 8, is maintained in this compressed state by two retractable pins 9.

Besides, an inflatable chamber 10 having an inner supple wall 11 is provided within tube 7.

This chamber may be inflated by a compressed gas contained in a replaceable cartridge 12 located inside a cylindrical recess 13 provided at the central portion of the cylindrical hollow body 4. The cartridge 12 is maintained by stands 14.

In the stocking condition of the system, the full cartridge 12 remains impervious.

Just at the moment of use, it is striked by a striking pin 15 to pressurize the recess. The striking pin is provided on a piston 16 which is slidably fitted in recess 13. Sealing means, such as an O-ring, are provided between the piston and the recess. A compression spring 13 is interposed between a face of piston 16 and a threaded plug 19. The striking pin 15 is kept remote from the head of the cartridge by the end portion 20 of a control rod 21.

The recess 13 is communicated with the inside of the inflatable chamber 10 by means of a duct 22.

The system also comprises a prehension handle 23 provided at the opened free end of the rearward portion 5 of the body 4.

The handle 23 fullfils two functions : its simple prehension by a rescued person successively releases the pins 9 which retain the sleeve 6, then, the end portion 20 of the control rod 21 retaining the striking pin 15.

To these ends, the handle 23 is comprised of a fixed portion 24 integral with the body 4 and of a mobile portion 25 which is integral with an end of the control rod 21. When the handle 23 is grasped, the portion 25 is displaced and comes in abutment against the fixed portion. During this operation, the pins 9 are released by means of any device of a known type, such as a spring, a pawl, a lever or the like. Besides, and successively, the rod 21 is displaced. At the end of its axial movement, the portion 20 releases the piston 16.

In FIG. 3, the mobile portion 25 is provided with a pin 26 having a cross bar 28 at its free end. Each pin 9 is biased in abutment against the cross bar 28 by a spring 30. When one hand of the rescued person grasps the handle, the cross bar 28 releases both pins 9, so that the sleeve 6 may be extended by the spring 8 and come to the position shown in FIG. 2.

FIG. 2 represents the system after actuation.

The released sleeve 6 has extended axially around the hand, the wrist and the forearm of the rescued person.

Besides, the released striking pin 15 has striked and perforated the cartridge 12 and the exhaust of gas has inflated the inflatable chamber 10 through the duct 22. The pressure within chamber 10 is set to a value higher than the minimum value required for making the rescued person integral with the system and lower than a maximum admissible value, so that the system does not cause any physiological disorder to the rescued person.

Besides the means described in their characteristic combination, the device also has to be provided with supplemental means equally necessary for a practical utilization during a rescue action.

For instance, when the system is intended to be used for a rescue operation in an aquatic or marshy medium, it has to be equipped with means for making it float in a horizontal position. In the latter case, it is possible to provide the system with an impervious caisson 26 within the frustro-conical recess 3 of the body 4 and, at the other end of the system, with a buoying ring 27.

As another example, it is necessary that an intense light signalization 32 guide the rescued person towards the prehension handle 23.

It is also required that the rescue worker be informed that the system has become integral with the rescued person. This function may be fullfilled by an intense light signalization of a color different from the one of the previous signalization, or else, by emittance of a radio signal by means of a radio emitter located in caisson 26 and actuated by the displacement of the mobile portion 25 of the handle 23.

What is claimed is:

1. An automatic rescue system of the type comprising a physical, generally supple, link (2), said link being controlled at one of its extremities by a rescuer, the other extremity of said link being linked to a fastening system able to be made integral with a rescued person, characterized in that said fastening system is comprised of a mobile and inflatable sleeve (6), in that said system is fitted with a visible and easily sizable manual prehension element (23), said element being provided with tripping means (25) which are actuated by a mere hand grasping of this tripping element (25) and intended to firstly automatically and rapidly displace the sleeve (6) to place it around the forearm of the rescued person, and secondly to inflate said sleeve (6) to enclose the wrist and the forearm of the rescued person under a non-traumatising pressure.

2. A system as set forth in claim 1, characterized in that the sleeve (6) is comprised of a supple tube (7) which is unfoldable under the action of a spring (8) which is normally compressed and which is released by means stripped upon prehension of element (23), said tube (7) being provided with an inflatable chamber (10).

3. A system as set forth in claim 1, characterized in that it is provided with means (26, 27) for making it float in a horizontal position.

4. A system as set forth in claim 1, characterized in that it is provided with intense light signalisation means associated with the manual prehension element (23).

5. A system as set forth in claim 1, characterized in that it is provided with signalisation means actuated by the manual prehension element (23) so as to warn the rescuer that the system has been rendered jointly liable with the rescued person.

* * * * *